US008347804B2

(12) United States Patent
Van Loenhout et al.

(10) Patent No.: US 8,347,804 B2
(45) Date of Patent: Jan. 8, 2013

(54) MOORING SYSTEM

(75) Inventors: Adrianus Cornelis Josephus Van Loenhout, Leiden (NL); Marinus Uittenbogaard, Kamerik (NL); Jacob De Baan, Maassluis (NL)

(73) Assignee: Bluewater Energy Services B.V., Hoofddorp (NL)

( * ) Notice: Subject to any disclaimer, the term of this patent is extended or adjusted under 35 U.S.C. 154(b) by 413 days.

(21) Appl. No.: 12/594,469

(22) PCT Filed: Apr. 5, 2007

(86) PCT No.: PCT/EP2007/053366

§ 371 (c)(1),
(2), (4) Date: Jan. 8, 2010

(87) PCT Pub. No.: WO2008/122312

PCT Pub. Date: Oct. 16, 2008

(65) Prior Publication Data

US 2010/0107957 A1 May 6, 2010

(51) Int. Cl.
*B63B 21/00* (2006.01)

(52) U.S. Cl. ..... 114/230.1

(58) Field of Classification Search ..... 441/3, 4, 441/5, 256; 114/230.1, 230.12, 230.13, 230.2, 114/230.21, 293; 405/195.1, 224; 166/352, 166/354, 367

See application file for complete search history.

(56) References Cited

U.S. PATENT DOCUMENTS

| | | | | |
|---|---|---|---|---|
| 5,609,442 | A | 3/1997 | Horton | |
| 5,791,819 | A * | 8/1998 | Christiansen | 405/224 |
| 5,860,840 | A | 1/1999 | Boatman et al. | |
| 6,340,272 | B1 * | 1/2002 | Runge et al. | 405/203 |
| 6,945,736 | B2 | 9/2005 | Smedal et al. | |

FOREIGN PATENT DOCUMENTS

| | | | |
|---|---|---|---|
| WO | WO 93/24733 | A | 12/1993 |
| WO | WO 9324733 | A1 * | 12/1993 |
| WO | WO 97/06340 | A | 2/1997 |
| WO | WO 98/05550 | A | 2/1998 |

OTHER PUBLICATIONS

International Search Report of the European Patent Office in counterpart foreign application No. PCT/EP2007/053366 filed Apr. 5, 2007.

Written Opinion of the European Patent Office in counterpart foreign application No. PCT/EP2007/053366 filed Apr. 5, 2007.

* cited by examiner

*Primary Examiner* — Lars A Olson
*Assistant Examiner* — Anthony Wiest
(74) *Attorney, Agent, or Firm* — Steven M. Koehler; Westman, Champlin & Kelly, P.A.

(57) ABSTRACT

System for mooring a substantially cylindrical floating production, storage and offloading unit (FPSO), comprising a substantially cylindrical mooring element having un upper side for engaging the lower side of the FPSO, further comprising mooring lines for connection to the seabed, and operating means for realising an engagement between the mooring element and the FPSO, wherein the mooring element has such a specific weight that, when disconnected from the FPSO, it floats at a certain depth below the sea level.

18 Claims, 5 Drawing Sheets

MOORING SYSTEM

CROSS-REFERENCE TO RELATED APPLICATION

The present application is a national stage filing of International patent application Serial No. PCT/EP2007/053366, filed Apr. 5, 2007, and published as WO 2008/122312 in English.

BACKGROUND

The discussion below is merely provided for general background information and is not intended to be used as an aid in determining the scope of the claimed subject matter.

Aspects of the invention relate to a system for mooring a substantially cylindrical floating production, storage and offloading unit. Commonly used in the offshore hydrocarbon production industry are FPSO (Floating Production, Storage and Offloading) units. These FPSOs are commonly turret-moored.

The turret-mooring allows the FPSO to weathervane (pivot) around the turret into the most favorable heading.

Disconnectable turret-moored FPSOs have been built to allow the FPSO to leave the offshore location, for instance to have repairs or facility upgrades inshore, to get out of the projected route of an iceberg or to go to a sheltered area in case of a hurricane warning.

With an increasing number of production lines (risers) to the FPSO it becomes more and more difficult to design these turret mooring systems. As such permanently moored FPSO units have been designed and built which do not have a need to weathervane, and as such they do not require a turret system. For ship-shape hulls this can only be applied in mild weather areas. Another possibility is to design the FPSO hull as a cylindrical structure. Such shape can be moored in more harsh environments.

Presently, cylindrical shaped FPSO's (such as shown in U.S. Pat. No. 6,945,736) do not have a disconnectable mooring and riser system which allows these units to easily leave their offshore location without the mobilization of an installation spread.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

An aspect of the present invention is to provide a disconnectable mooring and riser system for a cylindrical shaped FPSO unit to allow it to easily leave its offshore location and make an easy hook-up to the mooring and riser system, after return at the offshore location.

A system for mooring a substantially cylindrical floating production, storage and offloading unit (FPSO)includes a substantially cylindrical mooring element having un upper side for engaging the lower side of the FPSO, mooring lines for connection to the seabed, and operating means for realising an engagement between the mooring element and the FPSO, wherein the mooring element has such a specific weight that, when disconnected from the FPSO, it floats at a predetermined depth below the sea level.

In the position of engagement between the FPSO and the mooring element, the FPSO is kept stable in its position by the mooring lines. In the disengaged position the mooring element floats below sea level and the FPSO is free to move away. The operating means are used to re-establish an engagement between the mooring element and the FPSO.

In one embodiment the operating means comprises a tension member attached to the FPSO for movement with respect thereto and having a free end which in a removable manner can be attached to the mooring element.

The tension member primarily is intended to provide a firm engagement between the mooring element and the FPSO.

Preferably there are at least three tension members. These may be spaced regularly along the circumference.

The tension members may comprise cable means cooperating with hoisting means. As an example of cable means steel cables or chains are mentioned. As an example of hoisting means winches are mentioned.

In case the FPSO is of the type supporting a drill rig, latter also may be used as operating means for establishing the engagement between the mooring member and FPSO.

The operating means also may comprise locking means for locking the mooring element to the FPSO once engaged therewith. Such locking means may be combined with the tension members mentioned before, but also may be separate means.

When the FPSO is of the type having its own propulsion means for altering its position, the mooring element comprises a recess for housing said propulsion means of the FPSO.

Generally the mooring element supports production lines (risers) such as for gas or oil. Then it is preferred that the system further comprises production lines connected to the mooring element having an upper end which is movable between a lower position when disconnected from the FPSO and an upper position for connection with the FPSO. This enables positioning the production lines in the upper position for connection to the FPSO and in the lower, sheltered position at the mooring element when the mooring element is disconnected from the FPSO.

In such a case it further is preferred that the FPSO comprises means for establishing a connection with the upper end of the production lines and for moving it between the lower and upper positions. The mooring element only allows the movement of the production lines relative thereto without causing this movement, and thus without itself being provided with means therefore.

Further it is preferred that the mooring element has a diameter which exceeds the diameter of the FPSO. Then, preferably, the mooring lines are attached to the mooring element at a virtual diameter exceeding the diameter of the FPSO, thus at greater distance from the center of the mooring element (and, thus, FPSO) providing an improved stable position thereof with increased damping behaviour.

Finally it is possible that the mooring element is shaped such that, when connected to the FPSO, it creates a restriction to the free flow of water at the interface between the mooring element and FPSO.

BRIEF DESCRIPTION OF THE DRAWINGS

Hereinafter aspects of the invention will be elucidated while referring to the drawings. Herein.

DETAILED DESCRIPTION OF THE ILLUSTRATIVE EMBODIMENTS

Figure 1:
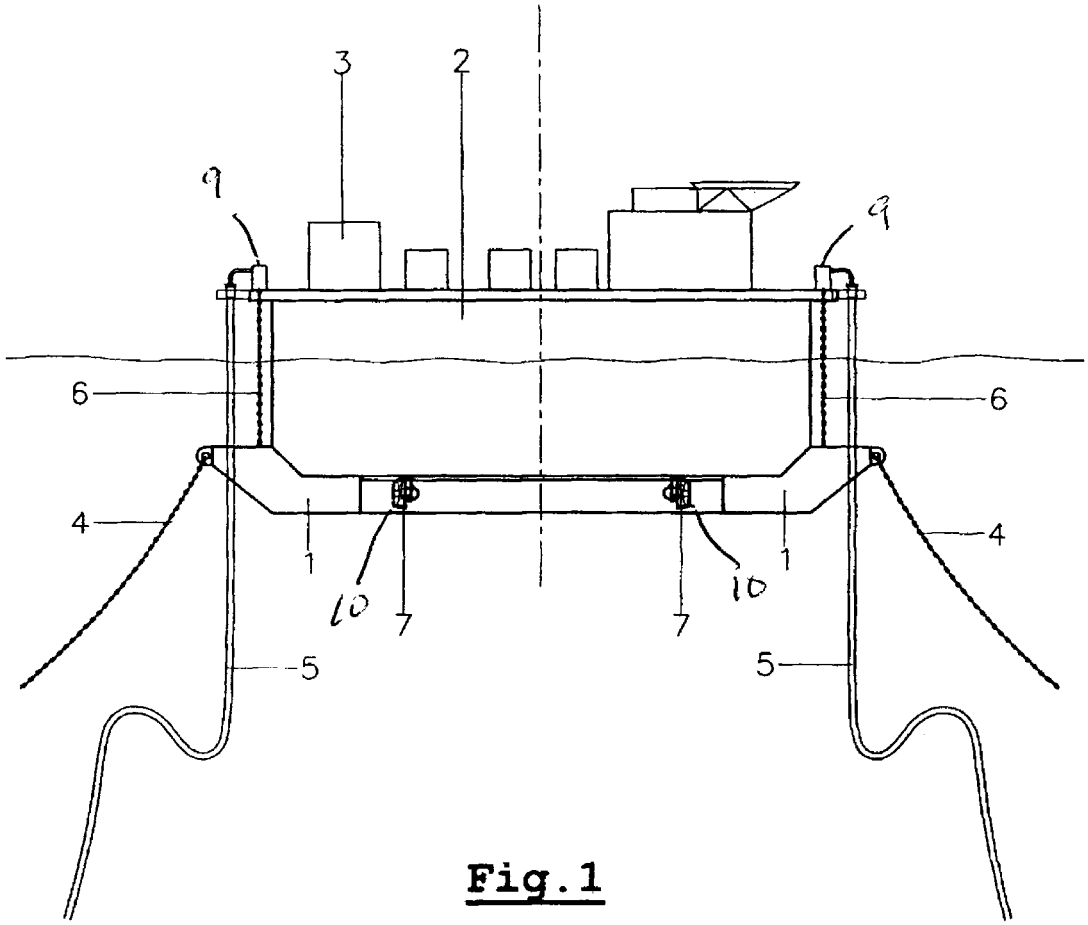
FIGS. 1 and 2 show schematically a cylindrical FPSO unit in connected and disconnected condition, respectively.

In a connected condition (FIG. 1), the disconnectable mooring element 1 is pulled against and engages the FPSO unit 2 by means of tension members 6 (such as for example steel cables or chains which can be wound off and onto winches 9. Preferably, as a minimum three of such tension members 6 are used (which, preferably, are regularly spaced along the circumference).

In said connected condition mooring lines 4 (e.g. anchor lines) are keeping both the mooring element 1 and the FPSO unit 2 on location, allowing hydrocarbons (such as gas or oil) to flow through production lines (risers) 5 to a production deck 3 of the FPSO unit.

Before the start of a disconnect operation, the risers 5 are released from the production deck 3 level and lowered to rest in or on the mooring element 1; thereafter the disconnect operation can be executed by releasing the tension members 6. It is noted that there also may be separate locking means for locking the mooring element to the FPSO, which locking means will be disabled for the disconnect operation. The tension members may be used for lowering the mooring element in a controlled manner.

Figure 2:
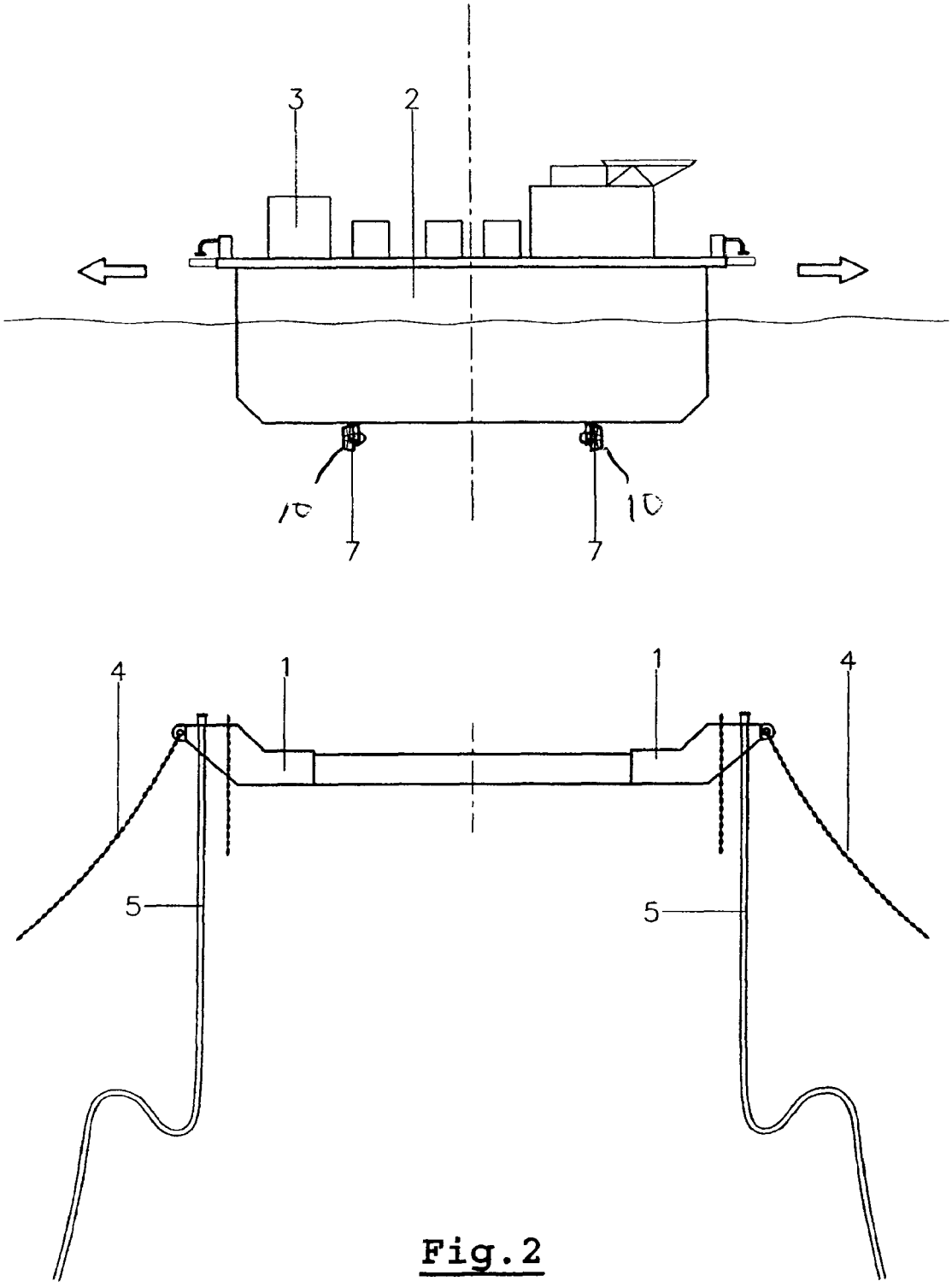

In disconnected condition (FIG. 2), the mooring element 1 floats at a pre-determined depth below the sea level (water surface). In this condition equilibrium is made between the water displacement of the mooring element 1 and the combined weight thereof with mooring lines 4, risers 5 and its structure, at the pre-determined depth.

Figure 3:
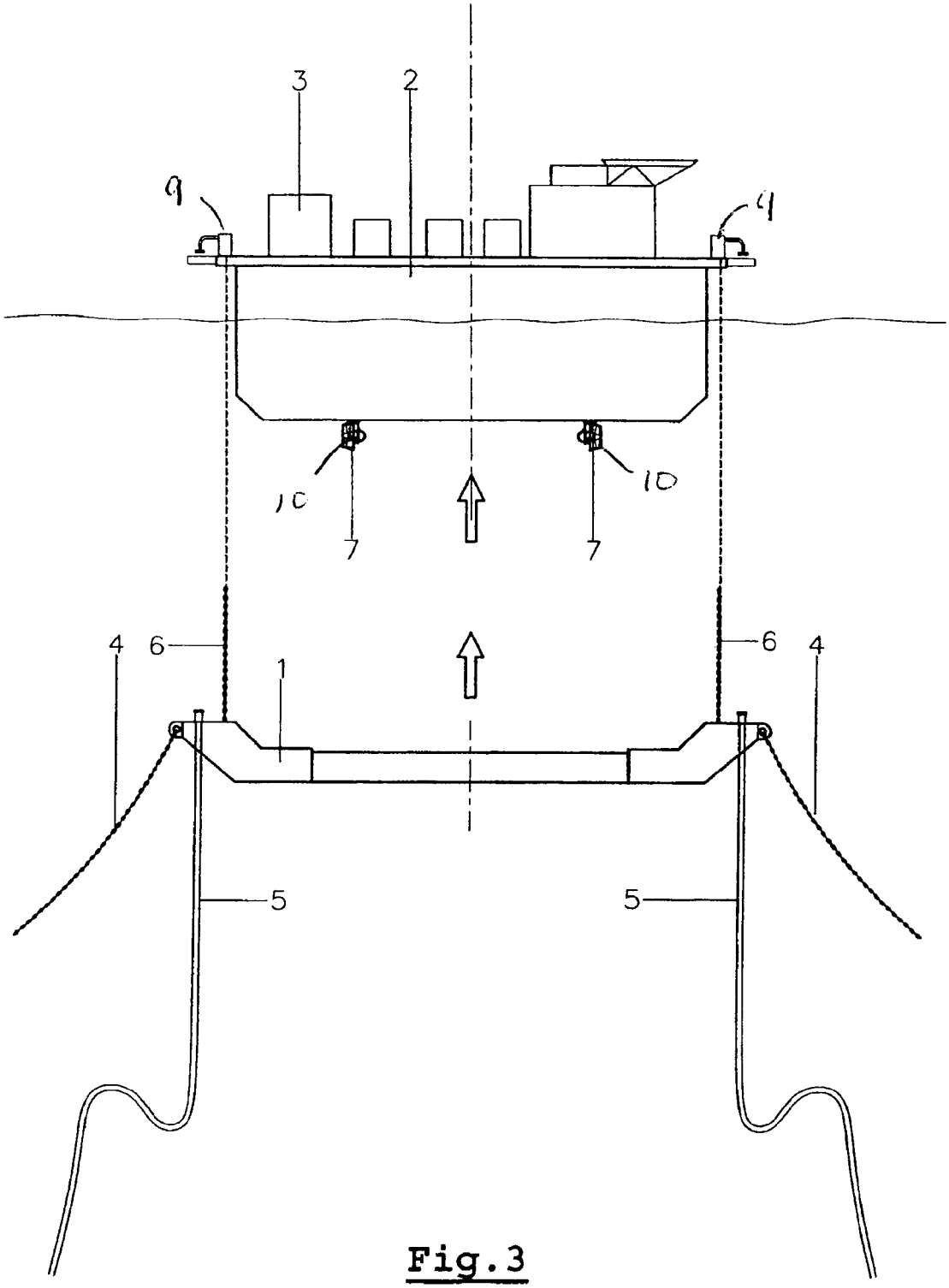
FIGS. 3 and 4 show the procedure of connecting the FPSO unit to a mooring element.
Figure 4:
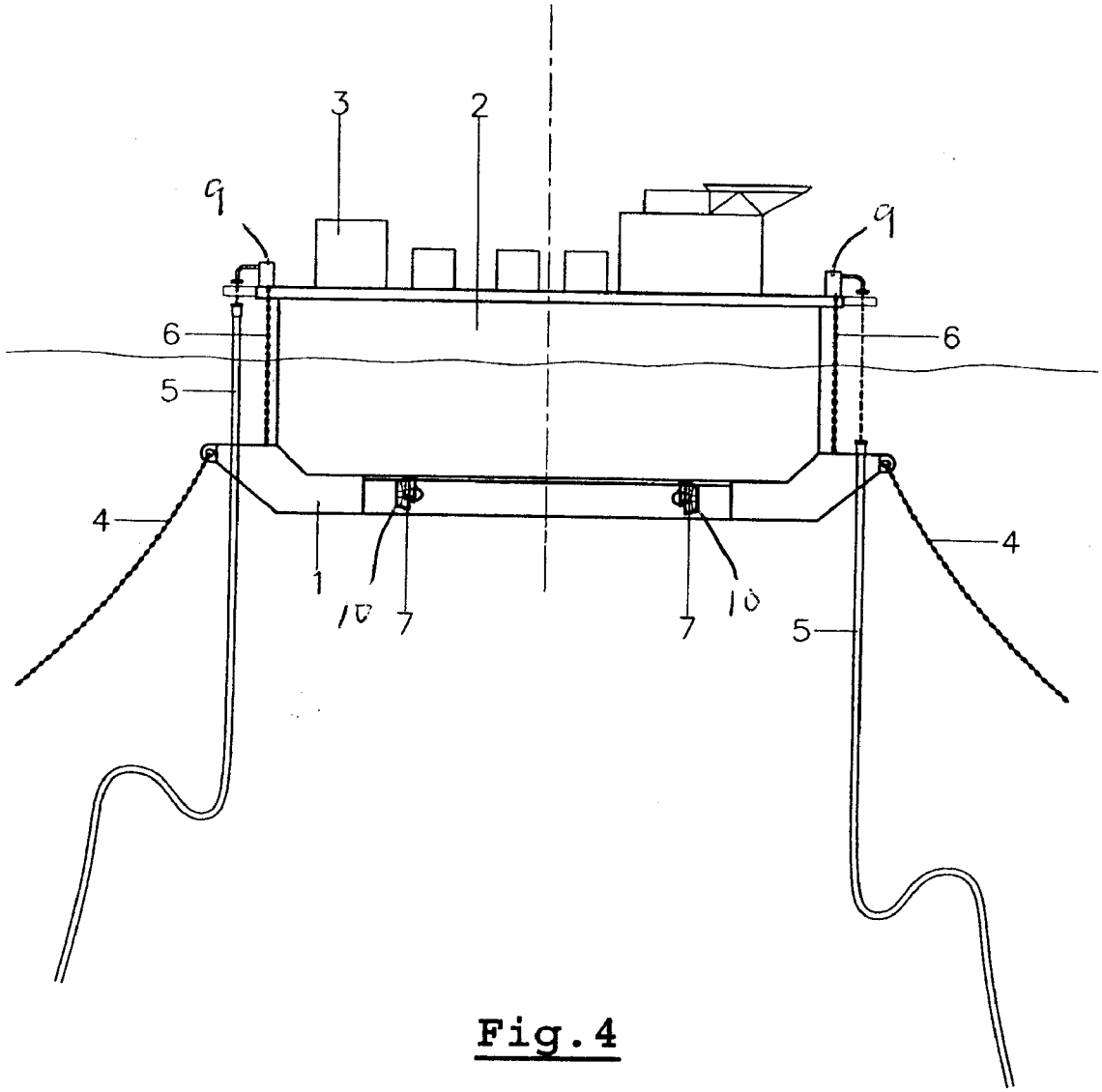

The hook-up or engagement operation (FIGS. 3 & 4) is executed by positioning the FPSO unit 2 above the submerged mooring element 1, lowering and hooking up the tension members 6 and pulling the mooring element against the FPSO unit by means of tensioning the tension members. If present, locking means then will lock the engagement position. After this the risers 5 are pulled upwards from the mooring element 1 to the production deck 3 and are connected there in an appropriate manner to facilities present there.

The tension members 6 may be the same as the means to lock the FPSO to the support structure in operation. However, this also may be separate means.

The diameter of the mooring element 1 may be larger than that of the FPSO 2. In such case mooring (anchor) lines 4 can be fitted further away from the FPSO center to provide more motion damping.

The FPSO 2 may be fitted with propulsion means 7 having a propeller 10 to position itself above the mooring element 1 prior to hook up, and to move out of the way in case of e.g. icebergs approaching. The mooring element then comprises a corresponding recess 11 for housing the propulsion means.

Figure 5:
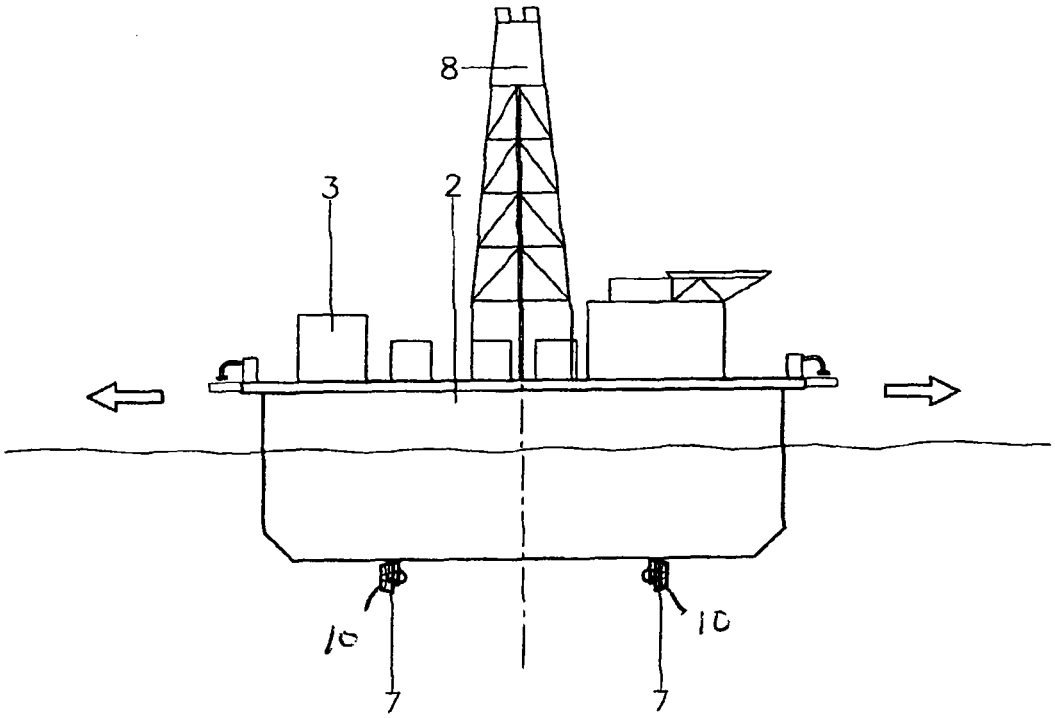
FIG. 5 shows a system with an FPSO provided with a drill rig.
Figure 5:
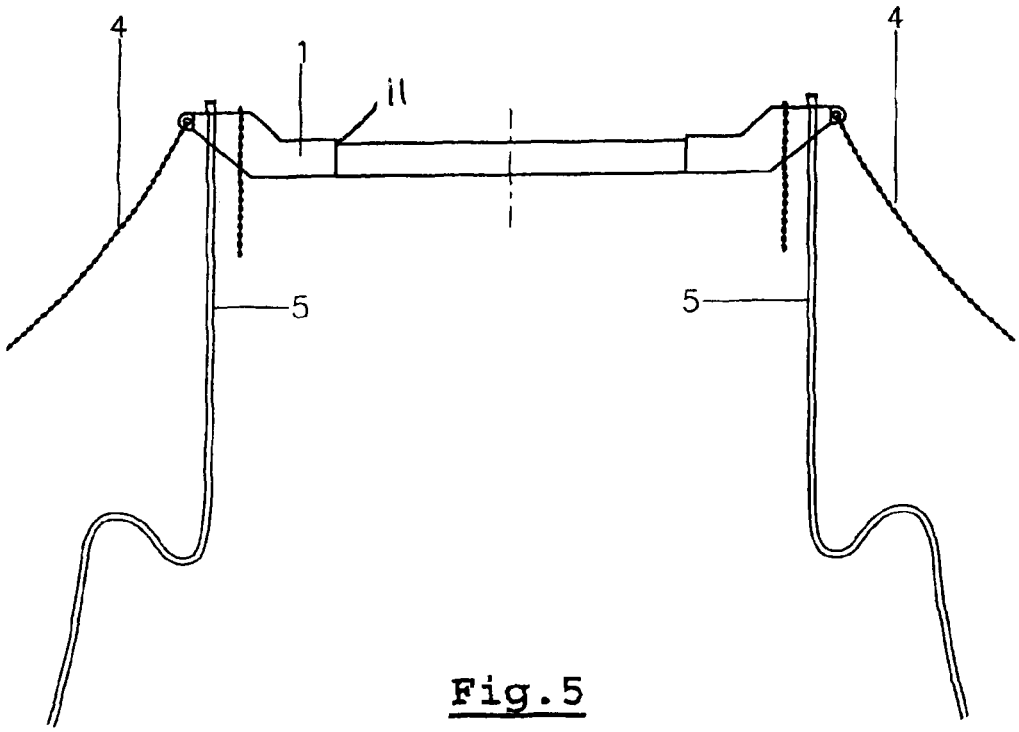

The FPSO 2 may be fitted with a drill rig 8 (FIG. 5) which can assist in the hook up and disconnect operation in lieu of, or in addition to, the tension members 6.

The invention is not limited to the embodiments described before, which may be varied widely within the scope of the invention as claimed in the appending claims. It is noted that the phrase 'cylindrical' also intends to indicate polygonal shapes approaching a pure cylindrical shape (such as for example a hexagonal or octagonal shape).

The invention claimed is:

1. A system for mooring a floating production, storage and offloading unit (FPSO), comprising:

a mooring element having an upper side configured to engage a lower side of the FPSO and a recess for housing a propeller of the FPSO, wherein the mooring element has a weight that when disconnected from the FPSO the mooring element is submerged at a depth below sea level, mooring lines configured to secure the mooring element relative to a seabed, and at least one tension member coupled to the FPSO and attachable to the mooring element to raise the mooring element via application of tension to the at least one tension member to provide an engagement between the mooring element and the FPSO.

2. The system according to claim 1 wherein the system comprises at least three tension members.

3. The system according to claim 1 wherein the at least one tension member comprises a cable cooperating with a hoist.

4. The system according to claim 1 comprising a tensioning device configured to supply the tension to the at least one tension member.

5. The system according to claim 1, further comprising production lines connected to the mooring element having an upper end which is movable between a lower position when disconnected from the FPSO and an upper position for connection with the FPSO.

6. The system according to claim 1, wherein the mooring element and the FPSO are generally cylindrical and a diameter of the mooring element is larger than a diameter of the FPSO.

7. The system according to claim 1, wherein the mooring element is shaped such that, free flow of water is restricted at an interface between the FPSO and the mooring element when engaged relative to the FPSO.

8. A system for mooring a floating production, storage and offloading unit (FPSO), comprising:

a mooring element having an upper side configured to engage a lower side of the FPSO and a recess configured to receive a propeller projecting downwardly from a bottom surface of the FPSO, the mooring element having a weight such that when disconnected from the FPSO, the mooring element is submerged at a depth below sea level;

mooring lines attached to the mooring element to secure the mooring element relative to a seabed, separate from the FPSO; and at least one tension member coupled to the FPSO and having a free end attachable to the mooring element to provide an engagement between the mooring element and the FPSO via application of tension to the at least one tension member.

9. The system according to claim 8, wherein the at least one tension member comprises a cable including a hoist.

10. The system according to claim 8, further comprising production lines connected to the mooring element having an upper end which is movable between a lower position when disconnected from the FPSO and an upper position for connection with the FPSO.

11. The system of claim 8 and comprising a tensioning device on the FPSO to supply tension to the at least one tension member to pull the mooring element against the FPSO.

12. The system of claim 11 wherein the tensioning device is a winch.

13. The system of claim 8 wherein the free end of the at least one tension member is hooked to the mooring element.

14. A method comprising:

positioning a floating production, storage and offloading unit (FPSO) having a downwardly projecting propeller over a submerged mooring element moored to a seabed by mooring lines, the submerged mooring element having a recess;

hooking at least one tension member coupled to the FPSO to the submerged mooring element; and supplying tension to the at least one tension member to raise the submerged mooring element such that an upper side of the mooring element engages against a lower side of the FPSO and the downwardly projecting propeller of the FPSO is received within the recess of the mooring element.

15. The method of claim 14 and comprising:

locking the FPSO to the mooring element.

16. The method of claim 14 and comprising:

pulling a production line upward from the mooring element to the FPSO; an connecting the production line to facilities on the FPSO.

17. The method of claim 14 and comprising:

releasing the tension on the at least one tension member to lower the mooring element to a submerged depth.

18. The method of claim 17 and comprising:

disconnecting a production line prior to releasing the tension on the at least one tension member to lower the mooring element.

* * * * *